United States Patent [19]

Kimura et al.

[11] Patent Number: 5,066,963

[45] Date of Patent: Nov. 19, 1991

[54] INK JET HEAD HAVING HEAT-GENERATING RESISTOR COMPRISED OF A COMPLEX COMPOUND

[75] Inventors: Isao Kimura, Hiratsuka; Kenji Hasegawa, Isehara, both of Japan

[73] Assignee: Canon Kabushiki Kaisha, Tokyo, Japan

[21] Appl. No.: 670,402

[22] Filed: Mar. 15, 1991

Related U.S. Application Data

[63] Continuation of Ser. No. 510,885, Apr. 18, 1990, abandoned.

[30] Foreign Application Priority Data

Apr. 18, 1989 [JP] Japan ..... 1-96419

[51] Int. Cl.[5] ..... B41J 2/05

[52] U.S. Cl. ..... 346/140 R; 338/308

[58] Field of Search ..... 346/140, 76 PH; 338/309, 308

[56] References Cited

U.S. PATENT DOCUMENTS

| | | | |
|---|---|---|---|
| 4,296,309 | 10/1981 | Shinmi | 346/76 PH |
| 4,313,124 | 1/1982 | Hara . | |
| 4,336,548 | 6/1982 | Matsumoto | 346/140 |
| 4,345,262 | 8/1982 | Shirato et al. . | |
| 4,429,321 | 1/1984 | Matsumoto . | |
| 4,450,457 | 5/1984 | Miyachi et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,694,306 | 9/1987 | Ikeda et al. | 346/140 |
| 4,723,129 | 2/1988 | Endo et al. . | |
| 4,740,796 | 4/1988 | Endo et al. . | |
| 4,847,639 | 7/1989 | Sugata | 346/140 |

FOREIGN PATENT DOCUMENTS

| | | |
|---|---|---|
| 2540435 | 8/1984 | France . |
| 54-56847 | 5/1979 | Japan . |
| 59-135166 | 8/1984 | Japan . |
| 59-123670 | 7/1984 | Japan . |
| 59-138461 | 8/1984 | Japan . |
| 60-71260 | 4/1985 | Japan . |
| 62-202754 | 9/1987 | Japan . |
| 62-202755 | 9/1987 | Japan . |

*Primary Examiner*—Joseph W. Hartary

*Attorney, Agent, or Firm*—Fitzpatrick, Cella, Harper & Scinto

[57] ABSTRACT

A substrate for an ink jet recording head comprises a support and an electrothermal transducer provided on said support and comprising a heat-generating resistor member and electrodes electrically connected to said heat-generating resistor member, wherein said heat-generating resistor member is comprised of a complex compound comprising a metal boride, silicon and nitrogen.

26 Claims, 3 Drawing Sheets

INK JET HEAD HAVING HEAT-GENERATING RESISTOR COMPRISED OF A COMPLEX COMPOUND

This application is a continuation of application Ser. No. 07/510,885 filed Apr. 18, 1990, now abandoned.

BACKGROUND OF THE INVENTION

1. Field of the Invention

This invention relates to an ink jet head which performs recording by discharging ink utilizing the heat energy generated by an electrothermal transducer, a substrate to be used for formation of said head, and an ink jet apparatus equipped with said head.

2. Related Background Art

Ink jet system described in U.S. Pat. Nos. 4,723,129, 4,740,796, etc. (namely bubble jet system called by Canon K. K.) can perform recording of high precision and high quality at high speed and high density and, s also suitable for color formation, and compaction, which is attracting increasing attention in recent years. In a representative example of the device to be used for this system, there exists a heat acting portion which permits heat to act on ink for discharging ink (liquid for recording, etc.) by utilizing heat energy. That is, by providing a heat-generating resistor having a heat-acting portion corresponding to an ink pathway, ink is abruptly heated to form bubbles by utilizing the heat energy generated from the heat-generating resistor and ink is discharged through the bubble formation.

The heat-acting portion is apparently similar in part to the constitution of the so called thermal head of the prior art from the standpoint that heat is permitted to act on an objective material, but the fundamental technique is greatly different in the point that the heat-acting portion is directly in contact with ink, the point that the heat-acting portion is exposed to mechanical shock brought about by cavitation by repeated bubble formation and bubble extinction of ink, further erosion in some cases, and also the point that the heat-acting portion is exposed to elevation and dropping of temperature approximately by 1000° C. within an extremely short time on the order of $10^{-1}$ to 10 micro-seconds. Therefore, the thermal head technique cannot be applied to the bubble jet technique as a matter of course. Thus, it is impossible to discuss the thermal head technique and the ink jet technique within the same category.

Whereas, as the material of the heat-generating resistor constituting the electrothermal transducer possessed by the ink jet recording head, because it becomes very high in temperature, materials which are stable even under high temperature state and also excellent in oxidation resistance have been employed, such as nitrides, carbides, silicides, borides of high melting metals, transistion metals, etc.

In recent years, in response to the demands of high density recording and high speed recording in ink jet apparatus by use of ink jet recording head, the method of increasing the power applied on a heat-generating resistor or shortening the pulse width of current width is going to be employed. In that case, the heat-generating resistor is heated to further higher temperature, and therefore a heat-generating resistor having higher heat resistance is demanded.

Also, when the size of the heat-generating resistor is made smaller for increasing the recording density, the area resistance of the heat-generating resistor is made substantially constant, and therefore only the resistance value as the electroconductor in the plural number of heat-generating resistors as a whole is increased, whereby the electric power consumption will be increased in the plural number of the heat-generating resistors as a whole.

Further, power increase leads to enlargement of IC capacity for driving, which increase of IC capacity in turn brings about elevation of the cost of ink jet head, etc.

Accordingly, in order to correspond to demands for high density recording, high speed recording, while reducing electric power consumption, for example, various methods for enhancing specific resistance of heat-generating resistors have been investigated.

For example, as the method for enhancing specific resistance without changing the shape or, the film thickness of a heat-generating resistor, there is the method of adding nitrogen, oxygen, etc. as the component at a predetermined ratio in the composition of the heat-generating resistor in order to obtain a desired specific resistance.

On the other hand, there has been also known the method of effecting higher resistance by changing the film thickness of heat-generating resistor without changing its material.

However, according to the investigations by the present inventors, in the heat-generating resistor made to have higher resistance by the method of adding nitrogen, oxygen, etc. as mentioned above, increase of electric power consumption accompanied with great reduction in resistance value was observed as the driving electric power was increased. This may be considered to be due to the fact that most of the components added exist in the state free from the heat-generating resistor forming compound which is the base.

On the other hand, when specific resistance is increased by making thinner the film thickness of the heat-generating resistor, since the film thickness is required to be controlled correctly in this region, a problem is involved in stability of production. Moreover, the effect of gas and, moisture absorption on the heat-generating resistor surface appears to worsen the stability of the heat-generating resistor itself, and therefore the advantage is further smaller as compared with the increase of resistance of the heat-generating resistor by addition of nitrogen, oxygen, etc. as described above.

SUMMARY OF THE INVENTION

One object of the present invention is to solve the problems as described above and provide a substrate for an ink jet recording head equipped with an electrothermal transducer, which can set a high specific resistance value, has a stable heat-generating resistor member with little change in resistance value accompanied with increase of driving electric power, and is also excellent in durability, and an ink jet recording head comprising the substrate as a part of its constitution and an ink jet recording apparatus equipped with the head.

Another object of the present invention is to provide a substrate for an ink jet recording head comprising a support and an electrothermal transducer provided on said support and comprising a heat-generating resistor member and electrodes electrically connected to said heat-generating resistor member, wherein said heat-generating resistor member is comprised of a complex compound comprising a metal boride, silicon and nitrogen.

Still another object of the present invention is to provide an ink jet recording head comprising a substrate for the ink jet recording head comprising a support and an electrothermal transducer provided on said support and comprising a heat-generating resistor member and electrodes electrically connected to said heat-generating resistor member, said heat-generating resistor member being comprised of a complex compound comprising a metal boride, silicon and nitrogen, wherein said heat-generating resistor member is used to generate heat energy to be utilized for discharging a liquid.

Yet another object of the present invention is to provide an ink jet recording apparatus comprising an ink jet recording head comprising a substrate for the ink jet recording head comprising a support and an electrothermal transducer provided on said support and comprising a heat generating resistor member and electrodes electrically connected to said heat-generating resistor member, said heat-generating resistor member being comprised of a complex compound comprising a metal boride, silicon and nitrogen, and means for carrying a recording medium, wherein said heat generating resistor member is used to generate heat energy to be utilized for discharging a liquid.

According to such present invention, high quality recording, high speed recording and low electric power consumption recording, etc. can be realized.

DETAILED DESCRIPTION OF THE PREFERRED EMBODIMENTS

The present inventors have studied intensively in order to cancel the problems as described above, and consequently found that the object as mentioned above can be accomplished when the heat-generating resistor member of ink jet head is constituted of a complex compound containing 4 elements of a metal element, boron (B), silicon (Si) and nitrogen (N) at a specific composition ratio. It has been also found that the metal element contained in the complex compound constituting the heat-generating resistor member according to the present invention should be preferably at least one element selected from the group consisting of Ti, V, Cr, Zr, Nb, Mo, Hf, Ta and W, and among them optimally Hf. And, the present inventors have accomplished the present invention on the basis of these findings.

In the complex compound containing such four elements at a specific composition ratio, the metal element forms primarily a boride, Si contains primarily both of the state of a nitride and the state of Si single substance (namely the state of Si-Si bond) as described later 1 and it may be imaged that these facts have brought about consequently extremely good characteristics.

The present inventors prepared a plurality of samples containing the four elements as described above at predetermined composition ratios according to the sputtering method.

Figure 4:
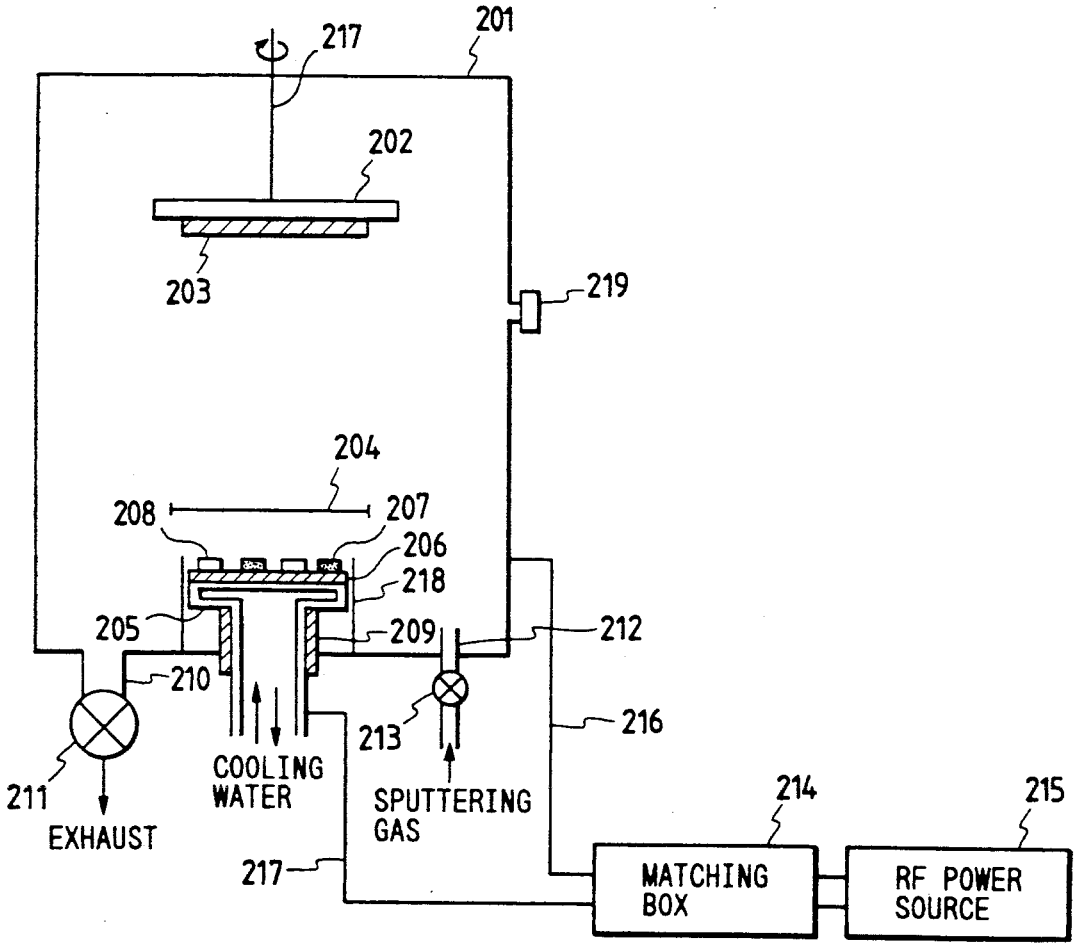
FIG. 4 is a schematic illustration showing the sputtering apparatus to be used for formation of the heat-generating resistor layer according to the present invention.

Each sample was prepared by means of a sputtering apparatus shown in FIG. 4 (trade name: Sputtering Apparatus CFS-8EP, manufactured by Tokuda Seisakusho Co.) by forming films on a Si single crystal substrate having a thermally oxidized $SiO_2$ film formed to 5.0 μm thereon. In FIG. 4, 201 shows a film forming chamber. 202 is a substrate holder for holding the substrate 203 provided within the film forming chamber 201. The holder 202 has a heater (not shown) for heating the substrate 203 built therein. The substrate holder 202 is supported by a rotatory shaft 217 extending from a driving motor (not shown) provided outside of the system, vertically movable and designed so as to be rotated. At the position opposed to the substrate 203 within the film forming chamber 201 is provided a target holder 205 for holding a target for film formation. 206 is a plate metal boride target of 99.8 wt.% or higher purity placed on the surface of the target holder 205. 207 is a sheet Si target of 99.9 wt.% or higher purity arranged on the metal boride target. Similarly, 208 is a sheet $Si_3N_4$ target of 99.9 wt.% or higher purity arranged on the metal boride target. The Si target 207 and the $Si_3N_4$ target 208 are arranged each in a plural number of predetermined areas at predetermined intervals on the surface of the metal boride target 206 as shown in FIG. 4. Individual areas and arrangements of the Si target 207 and the $Si_3N_4$ target 208 are determined on the basis of a calibration curve, which is prepared by previously grasping how the relationship of the area ratio of the three targets should be made for obtaining a film containing the four elements at a predetermined composition ratio.

218 is a protective wall which covers the side faces of the targets 206, 207 and 208 so that they may not be sputtered by plasma from their side faces. 204 is a shutter plate provided so as to be horizontally movable to shield the space between the substrate 203 and the targets 206, 207 and 208 at the position of the upper part of the target holder 205. The shutter plate 204 is used as described below. That is, before initiation of film formation, it is moved to the upper part of the target holder 205 holding the targets 206, 207 and 208, an inert gas such as argon (Ar) gas, etc. is introduced into the film forming chamber 201 through a gas feeding pipe 212, the gas is formed into plasma by application of RF power from a RF power source 215, and the targets 206, 207 and 208 are sputtered with the plasma formed to remove the impurities on the respective surfaces of the targets. Then, the shutter plate 204 is moved to the position (not shown) which does not interfere with film formation.

The RF power source 215 is connected electrically to the surrounding wall of the film chamber 201 through an electroconductive wire 216, and also connected electrically to the target holder 205 through an electroconductive wire 217. 214 is a matching box.

The target holder 205 is provided with a mechanism (not shown) which circulates cooling water internally thereof so that the targets 206, 207 and 208 may be maintained at desired temperatures during film formation. In the film forming chamber 201 is provided a discharge pipe 210 for discharging internally of the film forming chamber, and the discharge pipe is communicated to a vacuum pump (not shown) through a discharge valve 211. 202 is a gas feeding pipe for introducing a gas for sputtering such as argon gas (Ar gas), helium gas (He gas) into the film forming chamber 201. 213 is a flow rate controlling valve for the gas for sputtering provided at the gas feeding pipe. 209 is an insulator provided between the target holder 205 and the bottom wall of the film forming chamber 201 for insulating electrically the target holder 205 from the film forming chamber 201. 219 is a vacuum gauge provided on the film forming chamber 201. By said vacuum gauge, the inner pressure in the film forming chamber 201 is automatically detected.

In the device shown in FIG. 4, only one target holder is provided as described above, but a plurality of target holders can be also provided. In that case, those target holders are arranged at equal intervals on concentric circles at the position opposed to the substrate 203 within the film forming chamber 201. And, to the respective target holders are connected electrically individually independent RF power sources through the matching box. In the case as described above, since three kinds of targets, namely metal boride target, Si target and $Si_3N_4$ target are used, three target holders are arranged in the film forming chamber 201 as described above, and the respective targets are individually provided on the respective target holders. In this case, since predetermined RF powers can be applied independently on the individual targets, a film in which one or more of the elements of metal, boron, Si and N is varied in the film thickness direction can be formed by varying the composition ratio of the film constituting elements to be formed into a film.

Each sample by use of the device shown in FIG. 4 as described above was prepared according to the film forming conditions shown below except that the Si target 207 and the $Si_3N_4$ target 208 were arranged on the metal boride target 206 on the basis of the calibration curve prepared previously about non single crystalline substance (film) of the four elements to be obtained.

Substrate arranged on the substrate holder 202:

Si single crystal substrate of 4 inch $\phi$ size having 5.0 $\mu$m thick $SiO_2$ film formed on the surface (mfd. by Wacker Corp.) (3 sheets).

Substrate setting temperature: 50 ° C.

Base pressure: $2.6\times10^{-4}$ Pa or lower

High frequency (RF) power: 500 W

Gas for sputtering and gas pressure: argon gas, $4\times10^{-3}$ Torr

Film forming time: 30 minutes

Of the respective samples obtained as described above, a partial specimen of the samples were subjected to compositional analysis by performing X-ray photoelectric spectroscopic analysis by means of ESCA-750 manufactured by Shimadzu Corp.

Next, for each sample, by use of another specimen, film thickness and specific resistance were measured, and further by use of still another specimen, step stress test (SST) for observation of heat resistance and impact resistance, etc. was conducted. SST was conducted according to the same manner as the step stress test as described later. As the result, of overall investigation of these results, the following conclusions were obtained.

That is, the above-mentioned problems can be cancelled dramatically to give a heat-generating resistor member particularly excellent in high temperature stability with high resistance which is also equal to or better than one of the prior art in durability can be obtained, when the complex compound constituting the heat-generating resistor member of an ink jet head contains the following four elements at a specific composition shown below.

8 atomic % $\leqq$ metal element $\leqq$ 31 atomic %

7 atomic % $\leqq$ B $\leqq$ 58 atomic %

5 atomic % $\leqq$ Si $\leqq$ 53 atomic %

6 atomic % $\leqq$ N $<$ 45 atomic %.

As the specific composition ratios of the four elements, the following ranges are preferred:

15 atomic % $\leqq$ metal atom $\leqq$ 24 atomic %

18 atomic % $\leqq$ B $\leqq$ 38 atomic %

19 atomic % $\leqq$ Si $\leqq$ 35 atomic %

18 atomic % $\leqq$ N $\leqq$ 38 atomic %.

Further, it is preferable for obtaining a heat-generating resistor member of high resistance and excellent high temperature stability that the ratio of numbers of atoms of Si tg N contained in the complex compound constituting the heat-generating resistor member be within the following range:

$$0.6 < Si/N \leqq 2.5$$

In addition, the ratio of numbers of atoms of Si to N is further preferably as follows:

$$0.7 < Si/N \leqq 1.3.$$

The heat-generating resistor member according to the present invention can be formed with a desired thickness on a support according to various thin film forming techniques such as the vapor deposition method, the sputtering method, the CVD method, etc. by use of starting materials capable of supplying the respective constituents of the complex compound as described above.

Referring now to the drawings, the present invention is described in detail.

Figure 1:
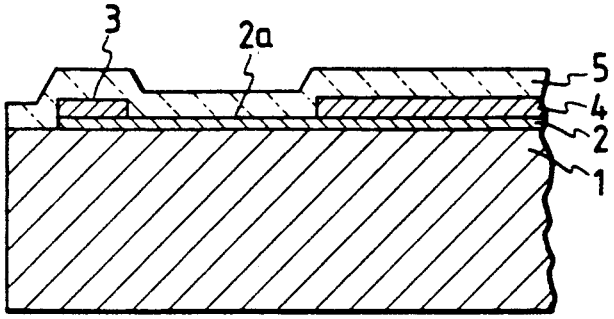
FIG. 1 is a schematic sectional view showing an example of the substrate an ink jet head according to the present invention.

FIG. 1 is a partial sectional view showing the structure of an example of the substrate for an ink jet recording head of the present invention.

The substrate has a structure, comprising an electrothermal transducer having a heat-generating resistor member 2 and a pair of opposed electrodes 3, 4 and a protective layer 5 provided on a support 1 formed by use of an insulating material such as silicon oxide, glass or ceramics, or a silicon single crystal member having a $SiO_2$ layer formed by thermal oxidation on the surface, etc.

The heat-generating resistor member 2 is formed of a thin film of the complex compound as described above. The portion of the heat-generating resistor member 2 between the electrodes 3 and 4 forms a heat-generating portion 2*a* which generates heat by current passage between the electrodes 3 and 4. The electrodes 3 and 4 are formed of a good conductor, such as Al, Au and Cu.

The protective film 5 has the function of protecting the portion positioned immediately below the liquid pathway of the electrothermal transducer possessed by the ink jet recording head prepared by use of the substrate against contact with ink, and can be formed of an insulating material such as $SiO_2$, SiC or SiN, etc.

The protective film 5 is not necessarily required to be formed of a single material, but may be also one having the multi-layer film constitution of the above-mentioned materials, or a structure provided with a metal thin film layer for cavitation resistance such as Ta on the outermost surface in contact with a liquid (ink, etc.).

The heat-generating resistor member 2 can be formed by subjecting a thin film comprising the above-described complex compound to patterning according to an appropriate patterning method such as photolithographic steps, etc.

Its film thickness and width, the interval of the electrodes 3, 4, etc. may be chosen selectively so that necessary characteristics can be obtained at the heat-generating portion of .the thin film heat-generating resistor member corresponding to the design of the objective ink jet recording head.

The thin film comprising the complex compound has the advantage that the desired high specific resistance value can be obtained under high driving power even when it is made a film having a thickness relatively easier in film thickness control (e.g. 500 Å–5 μm). The thickness of the layer of the heat-generating resistor member according to the present invention may be preferably 300 Å to 2 μm, more preferably 700 Å to 1 μm, optimally 1000 Å to 5000 Å.

On the substrate for ink jet with the constitution shown in FIG. 1 can be formed at least a liquid pathway communicated to a discharge opening to give the ink jet recording head of the present invention.

Figure 2:
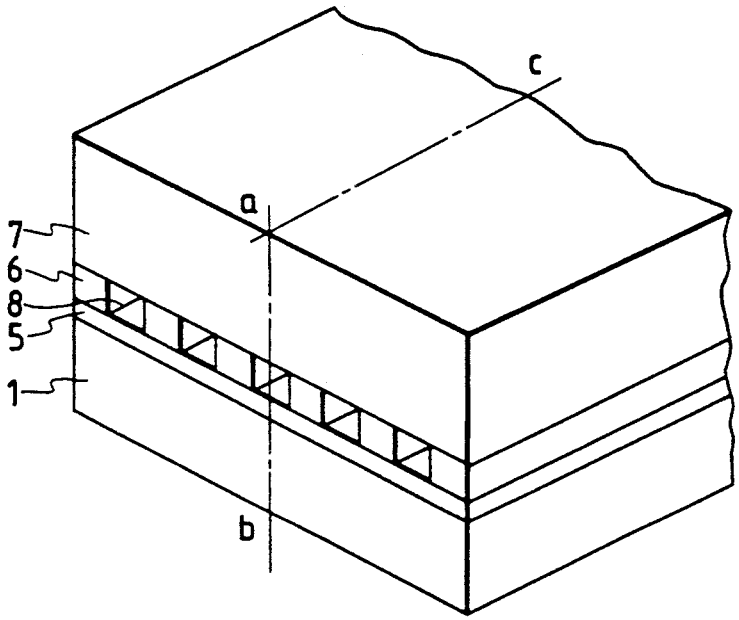
FIG. 2 is a schematic perspective view showing an example of the principal part of the ink jet head according to the present invention.
Figure 3:
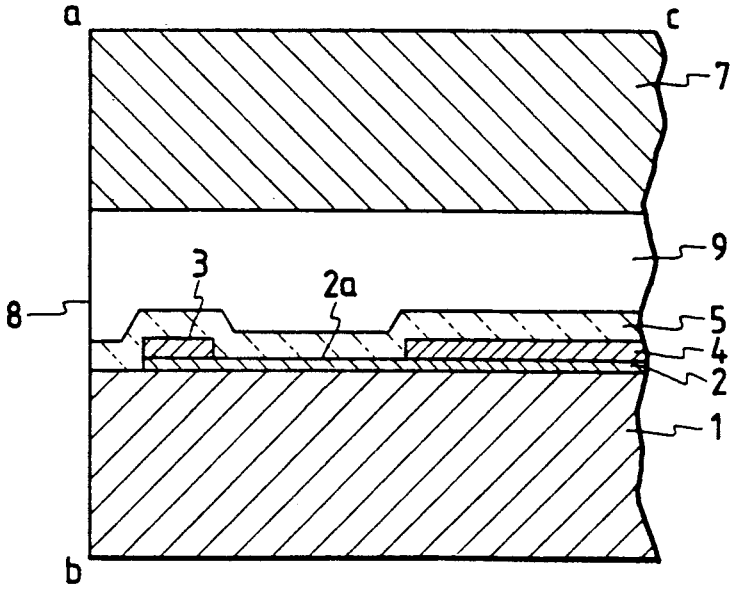
FIG. 3 is a schematic sectional view cut along the line a-b-c in FIG. 2.

FIG. 2 and FIG. 3 show the basic structures of the pertinent portion of an example of the ink jet recording head according to the present invention respectively as schematic perspective view and schematic sectional view.

In this example, on the substrate for ink jet with the above-described constitution are provided a partition wall 6 for providing the liquid pathway 9 communicated to the discharge opening 8 corresponding to the heat-generating portion 2*a* of the electrothermal transducer and a ceiling plate 7 for covering over the partitioning wall.

The partition wall 6 can be formed by use of a material excellent in liquid penetration prevention and liquid resistance action selected from organic insulating materials, having, for example, photo sensitivity such as epoxy resin, polyimide resin, phenol resin, etc., according to the known methods such as the method including photolithographic steps.

In FIG. 2, the discharge units for ink discharge including discharge opening, liquid pathway, heat-generating portion 2*a* of electrothermal transducer are sectionalized by the partition walls 6 to form the discharge unit in multiple fashion.

The ceiling plate 7 is the portion corresponding to the ceiling of the liquid pathway in each discharge unit, and can be formed of a material selected from glass, metal plate, ceramic, plastic, etc.

For bonding between the partition wall 6 and the ceiling plate 7, bonding by use of an adhesive such as epoxy resin or cyanoacrylate resin, etc. can be utilized.

In this ink jet recording head, since the above-described complex compound excellent in high temperature stability with high resistance is used as the material for the heat-generating resistor member, the recording head has a constitution which can sufficiently correspond to the demands of high density recording and high speed recording.

Other constitutions than the heat-generating resistor member in the present invention are not limited to the example as described above, but can take various constitutions.

For example, the recording head shown in the drawings has a constitution in which the direction in which the liquid is fed to the heat-generating portion and the direction in which the liquid is discharged from the discharge opening are substantially the same, but it may also have a constitution in which these directions are different from each other, for example, forming substantially a right angle therebetween.

EXAMPLE 1

A support provided with a $SiO_2$ layer of 5.0 μm film thickness by thermal oxidation treatment of the surface of a Si single crystal substrate was placed at a predetermined position within the RF sputtering apparatus as described above shown in FIG. 4, and further a $Si_3N_4$ chip (purity: 99.9 wt.% or higher) and a Si chip (purity: 99.9 wt.% or higher) were placed on a $HfB_2$ target of 5 inch in diameter (purity: 99.8 wt.% or higher) respectively at area ratios of 25% and 10% to the target, and film formation was effected on the $SiO_2$ layer of the support by sputtering under the conditions of a power during discharging of 0.5 kW, an Ar pressure during discharge of $4\times10^{-3}$ torr for 30 minutes The composition of the heat-generating resistor thin film obtained was analyzed by XPS (X-ray photoelectric spectrophotometry) under the state after the surface contaminated layer was removed by $Ar^+$ ion sputtering. The quantitative analytical values are shown in Table 1. Also, the film composition expressed in atomic % (rounded to the nearest whole number) is shown in Table 2.

TABLE 1

| | Hf | B | Si | N |
|---|---|---|---|---|
| Atomic ratio | 1.00 | 1.80 | 1.04 | 0.92 |

Further, by the same analytical apparatus the bonding states of the principal elements were judged.

As the result, it may be considered that, since the 4f orbital electron peak bonding energy of Hf is found at 15.9 eV, Hf has formed primarily a boride, while since the 2p orbital electron peak energy of Si is found at 99.0 eV, Si contains primarily the state of nitride and the same state as Si single substance (namely the state of Si—Si bond). B and N may be considered to have each formed boride and nitride (namely compounds), since the ls orbital bonding energies are found at 187.0 eV and 397.0 eV.

When the film thickness and the specific resistance of the heat-generating resistor thin film obtained were measured in conventional manner, they were found to be 1420 Å and 1150 Ω·cm, respectively.

Next, on the heat-generating resistor thin film on the support, an Al layer of 5000 Å was further laminated by electron beam vapor deposition, and these were subjected to patterning to a wiring width of 30 μm according to the photolithographic steps, followed further by removal of the portion corresponding to the heat-generating portion 2*a* of the electrode layer (30 μm×150 μm) to form an electrothermal transducer.

Further, a $SiO_2$ layer (layer thickness 2.0 μm) covering over the electrothermal transducer was formed as the protective layer 5 by RF sputtering to obtain a substrate for an ink jet head having the constitution shown in FIG. 1. The respective electrodes 3, 4 were provided with terminals (not shown) for receiving the signals from the an outside source connected thereto.

Next, partition walls 6 (height 50 μm) comprising a photosensitive polyimide resin in conventional manner including photolithographic steps so that the liquid pathways communicated to the discharge openings 8 may be positioned at the positions corresponding to the respective heat-generating portions, and further the glass plates 7 with a thickness of 1 mm covering over the partition walls were bonded by use of an epoxy resin to give an ink jet recording head with the constitution shown in FIG. 2 and FIG. 3.

On the heat-generating portion 2a of the ink jet recording head obtained, a rectangular pulse wave of 7 μs was applied at 3 kHz, and the application voltage was gradually raised by use of pure water as the recording liquid to determine the voltage at which bubble formation is initiated.

Next, a rectangular pulse wave of 3 kHz was applied so that the pulse voltage value increased by 1.0 V in every 2 minutes, and the change in the heat-generating resistor value (ΔR) was measured until the heat-generating resistor was broken. This test method is called step stress test (SST), and according to this test, the life including heat resistance, impact resistance under real driving state of an ink jet recording head can be evaluated.

From the results obtained and the resistance value Ro before practice of the test, resistance change rate (ΔR/Ro) were calculated. As the result, the heat-generating resistor member according to this Example exhibited excellent characteristics with the resistance value change immediately before breaking being small as +5.0 %. Besides, in the heat-generating resistor member according to this Example, the consumption current was sufficiently small as 136 mA. Hence, it has been found that the consumption power can be small and therefore an IC for driving with small capacity can be sufficiently effective.

Also, the margin M (application voltage immediately before breaking/application voltage at initiation of bubble formation) in the ink jet head of this Example was found to be 1.58, thus exhibiting sufficient heat resistance and, impact resistance.

Further, when printing was practically practiced by use of the ink jet head according to this Example, good printing quality could be obtained.

The evaluation results of Example 1 as described are summarized in Table 2.

EXAMPLES 2–12

According to the same procedure as in Example 1 except for varying variously the area ratios of the targets, heat-generating resistor thin films with various compositions were formed on supports, and then the ink jet heads shown in FIG. 2 and FIG. 3 were prepared in the same manner as described in Example 1.

For the respective Examples, various data were determined in the same manner as in Example 1, and the results are shown in Table 2. As can be seen from Table 2, all ink jet heads according to these Examples exhibited sufficiently great specific resistance values and sufficiently small resistance change rates, sufficiently small consumption currents, and further sufficient heat resistance and, impact resistance.

Also, when printing was practically practiced by use of the ink jet recording heads according to the respective Examples, good printing quality could be obtained in all of the Examples.

COMPARATIVE EXAMPLES 1–7

According to the same procedure as in Example 1 except for varying variously the area ratios of the targets, heat generating resistor thin films having various compositions were formed on supports. Then, the ink jet recording head shown in FIG. 2 and FIG. 3 were prepared in the same manner as in Example 1.

For respective Comparative Examples, various data were determined in the same manner as in Example 1, and the results are shown in Table 2. As can be seen from Table 2, the ink jet heads according to these Comparative Examples exhibited the results which could not be said to be necessarily satisfactory in of specific resistance value, resistance change rate, consumption current, heat resistance and impact resistance.

EXAMPLE 13

Formation of a heat-generating resistor thin film onto a support was performed by the RF magnetron simultaneous sputtering under the same conditions as in Example 1 except for using $HfB_2$ and Si (area ratio relative to $HfB_2$ target of 25%), and flowing $N_2$ gas at 0.5 SCCM into the Ar gas for sputter (gas pressure $4\times10^{-3}$ Torr) while mixing therewith.

The heat-generating resistor thin film had a film thickness of 1995 Å and a specific resistance value of 968 μΩ·cm.

By use of the heat-generating resistor thin film obtained, an ink jet recording head was prepared in the same manner as described in Example 1.

For this Example, various data were determined in the same manner as in Example 1, and the results are shown in Table 3. As can be seen from Table 3, the ink jet head according to this Example also exhibited sufficiently great specific resistance value and sufficiently small resistance change rate, sufficiently small consumption current, and further sufficient heat resistance and, impact resistance.

Also, when printing was practically practiced by use of the ink jet head according to this Example, good printing quality could be obtained.

EXAMPLES 14–16

According to the same procedure as in Example 13, except for varying variously the area ratios of the targets and the flow rate of $N_2$, heat-generating resistor thin films having various compositions were formed on supports. Then,,the ink jet heads shown in FIG. 2 and FIG. 3 were prepared in the same manner as in Example 13.

For the respective Examples, various data were determined in the same manner as in Example 13, and the results are shown in Table 3. As can be seen from Table 3, all the ink jet heads according to the Examples exhibited sufficiently great specific resistance values and sufficiently small resistance change rates, sufficiently small consumption currents and further sufficient heat resistance and, impact resistance.

Also, when printing was practically practiced by use of the ink jet heads according to the respective examples, good printing quality could be obtained in all the Examples.

COMPARATIVE EXAMPLES 8, 9

According to the same procedure as in Example 13 except for varying variously the area ratios of the targets and the flow rate of $N_2$, heat-generating resistor thin films having various compositions were formed on supports. Then, the ink jet heads shown in FIG. 2 and FIG. 3 were prepared in the same manner as in Example 13.

For the respective Comparative Examples, various data were determined in the same manner as in Example 1, and the results are shown in Table 3. As can be seen from Table 3, the ink jet heads according to these Comparative Examples exhibited the results which could not be said to be necessarily satisfactory in evaluation of either of specific resistance value, resistance change rate, consumption current, heat resistance and impact resistance.

OTHER EXAMPLES AND COMPARATIVE EXAMPLES (PART 1)

According to the same procedure as described in Examples 1 to 16 and Comparative Examples 1 to 9, except for using $TiB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient head resistance and impact resistance.

Also, when printing was practically carried out by use of the ink jet heads according to the respective Examples, good printing quality could be obtained in all of the Examples.

On the other hand, the ink jet heads according to the Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 2)

According to the same procedure as described in Examples 1 to 16 and Comparative Examples 1 to 9 except for using $VB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically carried out by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 3)

According to the same procedure as described in Examples 1 to 16 and Comparative Examples 1 to 9 except for using $CrB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically carried out by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 4)

According to the same procedure as described in Examples 1 to 16 and Comparative Examples 1 to 9, except for using $ZrB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was, practically carried out by use of the ink jet heads acqording to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 5)

According to the same procedure as described in Examples 1 to 16 and Comparative Examples 1 to 9except for using $NbB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically practiced by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 6)

According to the same procedure as described in Examples 1 to 16 and Comparative Examples 1 to 9, except for using $Mo_2B_5$ in place of $HfB_2$ as metal boride, the ink jet heads shown in FIG. 2 and FIG. 3 having the heat-generating resistor members of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically carried out by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 7)

According to the same procedure as described in Examples 1 to 16 and Comparative Examples 1 to 9 except for using $TaB_2$ in place of $HfB_2$ as metal boride, the ink jet heads shown in FIG. 2 and FIG. 3 having the heat-generating resistor member of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically carried out by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

OTHER EXAMPLES AND COMPARATIVE EXAMPLES (PART 8)

According to the same procedures as described in Examples 1 to 16 and Comparative Examples 1 to 9 except for using $W_2B_5$ in place of $HfB_2$ as metal boride, the ink jet heads shown in FIG. 2 and FIG. 3 having the heat-generating resistor members of the present invention were prepared.

All of the ink jet heads according to the Examples exhibited sufficiently great specific resistance values and sufficiently small resistance change rates, sufficiently small consumption current, and further sufficient heat resistance and impact resistance.

Also, when printing was practically carried out by use of the ink jet heads according to the respective Examples, good printing quality could be obtained in all of the Examples.

On the other hand, the ink jet heads according to Comparative Examples exhibited the results which could not be said to be necessarily satisfactory in either of the evaluations of specific resistance value, resistance change rate, consumption current, heat resistance and impact resistance.

The standards for the overall evaluation shown in FIG. 2 and FIG. 3 are shown in Table 4.

The heat-generating resistor member according to the present invention has high resistance value and small consumption power as described above, and therefore is particularly effective when used for an ink jet head of the form having functional elements provided structurally internally of the head substrate as disclosed in U.S. Pat. No. 4,429,321.

By mounting the ink jet held according to the present invention having the constitution as described above on a main apparatus and imparting signals to the head from the main apparatus an ink jet recording apparatus capable of performing high speed recording and high image quality recording can be obtained.

Figure 5:
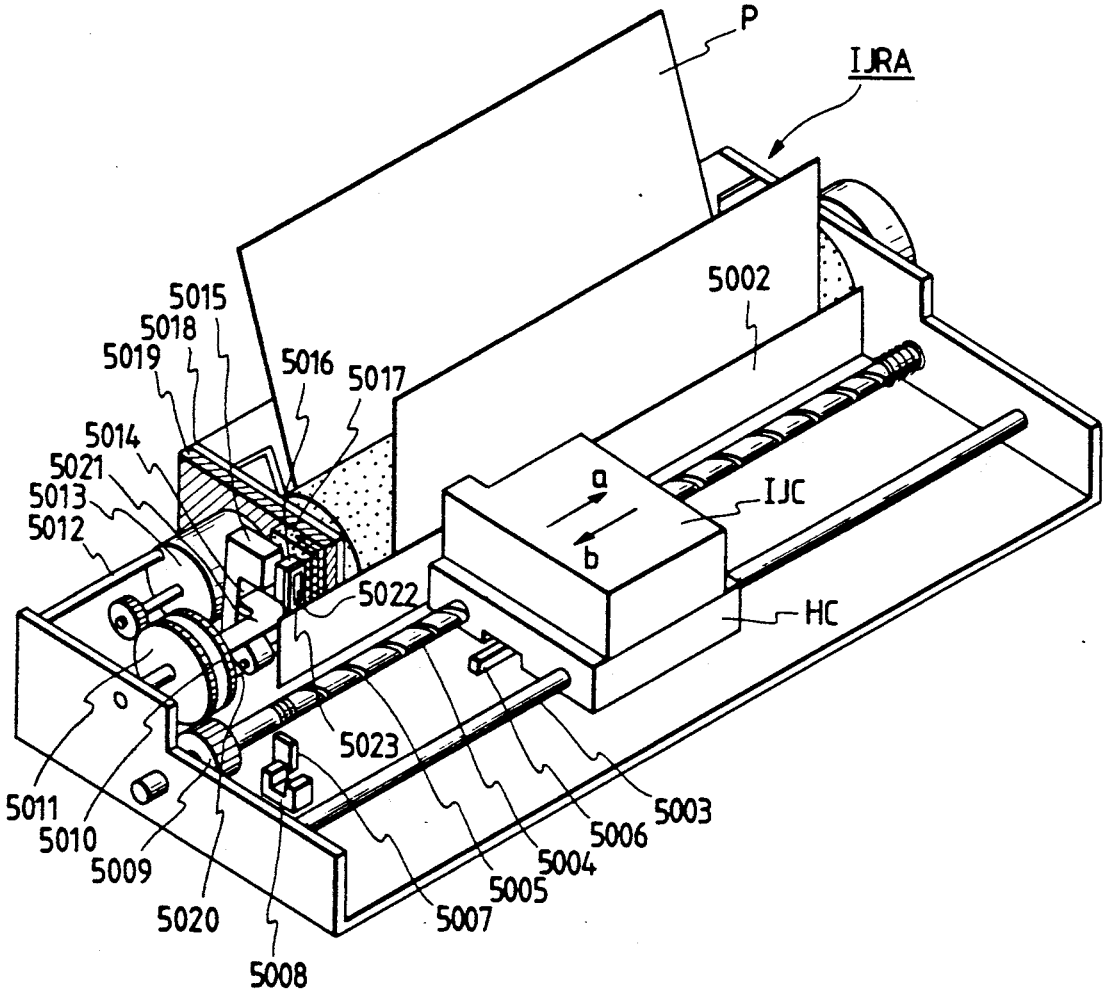
FIG. 5 is a schematic perspective view showing an example of the principal part of the ink jet apparatus equipped with the ink jet head according to the present invention.

FIG. 5 is a schematic perspective view showing an example of a jet recording apparatus IJRA to which the present invention is applied, and the carriage HC engaged with the spiral groove 5004 of a lead screw 5005 which rotates through driving force transmitting gears 5011, 5009 in associated movement with normal and reverse rotations of a driving motor 5013 has a pin (not shown) and is moved reciprocally in the directions of the arrows a, b. 5002 is a paper pressing plate, which presses paper over the carriage movement direction against a platen 5000. 5007, 5008 are photocouplers, which are home position detecting means for effecting rotation direction change-over of the motor 5013 by confirming the presence of a lever 5006 of the carriage in this region. 5016 is a member for supporting a cap member 5022 which caps the front face of a recording head IJC of the cartridge type with an ink tank provided integrally, and 5015 is an aspiration means which aspirates internally of the cap which performs aspiration restoration of the recording head through an opening 5023 within the cap. 5017 is a cleaning blade, 5019 is a member which enables movement of the blade in the direction of back and forth, and these are supported on a main body supporting plate 5018. The blade is not required to be in this form, but any cleaning blade well known in the art is applicable to this example, as a matter of course. 5012 is a lever for initiating aspiration of the aspiration restoration, which moves as accompanied with the movement with a cam 5020 engaged with the carriage, with the driving force from the driving motor being controlled by known transmission means such as clutch change-over, etc. A CPU which imparts signals to the electrothermal transducer provided at the ink jet head IJC, controls driving of the respective mechanisms as described and above is provided on the main body side (not shown).

In the examples of the present invention as described above, description is made by use of a liquid ink, but in the present invention, even an ink which is solid at room temperature can be used, provided it is softened at room temperature. In the ink jet apparatus as described above, it is generally practiced that temperature control is done so that the viscosity of ink may be within stable discharge range by controlling the temperature within the range of 30° C. to 70° C., and therefore any ink may be used which becomes liquid when imparting working recording signals. Also, by preventing positively temperature elevation with thermal energy by permitting it to be used as the energy for phase change from the solid state to the liquid state, or by use of an ink which is solidified under the state left to stand for the purpose of preventing evaporation of ink, or anyway use of an ink having the property which is liquefied for the first time by thermal energy such as one which is liquefied by imparting thermal energy corresponding to the recording signals but commences to be solidified already on the point when reaching the recording medium is also applicable in the present invention. In such case, the ink may be made in the form opposed to the electrothermal transducer under the state held as liquid or solid material at a porous sheet concavity or thru-hole as shown in Japanese Laid-Open Patent Application Nos. 54-56847 and 60-71260. In the present invention, one which is the most effective for the respective inks as mentioned above is one which practices the film boiling system as described above.

As to the representative constitution and principle of the recording head, and the recording apparatus of the ink jet system according to the present invention, for example, one practiced by use of the basic principle disclosed in, for example, U.S. Pat. Nos. 4,723,129 and 4,740,796 is preferred. This system is applicable to either of the so called on demand type and the continuous type. Particularly, the case of the on-demand type is effective because, by applying at least one driving signal which gives rapid temperature elevation exceeding nucleus boiling corresponding to the recording information on an electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble at least one droplet is formed. By taking the driving signals into pulse shapes growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linera liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat convertors as the discharging portion of the electricity-heat converter or Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally in the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

TABLE 2

| Example No. Comparative example No. | Target area ratios (%) | | | Film composition (Atomic %) | | | | | Film thickness (Å) | Specific Resistance (μΩ cm) | Resistance change (%) | Consumption Current (mA) | SST M | Overall evaluation |
|---|---|---|---|---|---|---|---|---|---|---|---|---|---|---|
| | $HfB_2$ | Si | $Si_3N_4$ | Hf | B | Si | N | Si/N | | | | | | |
| Example 1 | 65 | 10 | 25 | 21 | 38 | 22 | 19 | 1.13 | 1420 | 1150 | 5.0 | 136 | 1.58 | ◎ |
| 2 | 90 | 5 | 5 | 31 | 58 | 5 | 6 | 0.83 | 1258 | 470 | −2.8 | 200 | 1.53 | ○ |
| 3 | 70 | 8 | 22 | 22 | 35 | 19 | 24 | 0.79 | 1362 | 857 | −4.3 | 154 | 1.58 | ◎ |
| 4 | 70 | 15 | 15 | 24 | 36 | 22 | 18 | 1.22 | 1536 | 765 | 4.4 | 173 | 1.56 | ◎ |
| 5 | 70 | 20 | 10 | 26 | 37 | 24 | 13 | 1.84 | 1495 | 864 | 8.7 | 161 | 1.59 | ○ |
| 6 | 70 | 22 | 8 | 26 | 39 | 25 | 10 | 2.50 | 1320 | 872 | 7.2 | 151 | 1.62 | ○ |
| 7 | 50 | 13 | 37 | 15 | 18 | 29 | 38 | 0.76 | 1355 | 2754 | −4.7 | 86 | 1.57 | ◎ |
| 8 | 50 | 25 | 25 | 16 | 20 | 35 | 29 | 1.20 | 1462 | 3217 | 4.5 | 83 | 1.56 | ◎ |
| 9 | 50 | 37 | 13 | 19 | 22 | 42 | 17 | 2.47 | 1108 | 2114 | 10.3 | 89 | 1.62 | ○ |
| 10 | 30 | 23 | 47 | 8 | 7 | 40 | 45 | 0.89 | 2019 | 54200 | −9.5 | 24 | 1.51 | ○ |

TABLE 2-continued

| Example No. Comparative example No. | Target area ratios (%) HfB2 | Si | Si3N4 | Film composition (Atomic %) Hf | B | Si | N | Si/N | Film thickness (Å) | Specific Resistance (μΩ cm) | Resistance change (%) | Consumption Current (mA) | SST M | Overall evaluation |
|---|---|---|---|---|---|---|---|---|---|---|---|---|---|---|
| 11 | 30 | 47 | 23 | 10 | 9 | 53 | 28 | 1.89 | 2453 | 32523 | 11.2 | 34 | 1.61 | ○ |
| 12 | 70 | 7 | 23 | 23 | 32 | 17 | 28 | 0.61 | 1320 | 657 | −5.3 | 173 | 1.55 | ○ |
| Comparative example | | | | | | | | | | | | | | |
| 1 | 100 | — | — | 35 | 65 | — | — | — | 1255 | 230 | −2.8 | 286 | 1.56 | |
| 2 | 75 | — | 25 | 25 | 28 | 13 | 34 | 0.38 | 1290 | 880 | −29.0 | 148 | 1.39 | |
| 3 | 70 | 5 | 25 | 25 | 31 | 15 | 29 | 0.52 | 1320 | 754 | −31.5 | 162 | 1.32 | |
| 4 | 40 | — | 60 | 10 | 12 | 27 | 51 | 0.53 | 2420 | 75000 | −40.0 | 22 | 1.21 | |
| 5 | 43 | 57 | — | 19 | 22 | 59 | — | — | 1376 | 764 | 26.0 | 111 | 1.35 | |
| 6 | 80 | 15 | 5 | 35 | 39 | 19 | 7 | 2.71 | 1357 | 457 | 23.0 | 211 | 1.48 | |
| 7 | 95 | 2 | 3 | 38 | 55 | 3 | 4 | 0.75 | 1235 | 230 | −3.5 | 284 | 1.57 | |

TABLE 3

| Example No. | Target Area Ratio (%) HfB2 | Si | N2 Flow Amount (SCCM) | Film Composition (Atomic %) Hf | B | Si | N | Si/N | Film Thickness (Å) | Specific Resistance (μΩ cm) | Resistance Change (%) | Consumption Current (mA) | SST M | Overall evaluation |
|---|---|---|---|---|---|---|---|---|---|---|---|---|---|---|
| 13 | 75 | 25 | 0.5 | 25 | 28 | 26 | 21 | 1.23 | 1995 | 968 | 5.0 | 175 | 1.56 | ○ |
| 14 | 75 | 25 | 0.6 | 22 | 29 | 26 | 23 | 1.13 | 1320 | 1780 | 3.3 | 119 | 1.58 | ◎ |
| 15 | 70 | 30 | 0.5 | 21 | 28 | 31 | 20 | 1.55 | 1450 | 1052 | 5.0 | 106 | 1.55 | ◎ |
| 16 | 70 | 30 | 0.9 | 19 | 22 | 24 | 35 | 0.68 | 1235 | 5320 | −4.5 | 59 | 1.51 | ◎ |
| Comparative Example No. | | | | | | | | | | | | | | |
| 8 | 100 | — | 0.8 | 33 | 39 | — | 28 | — | 1400 | 650 | −36.0 | 180 | 1.46 | |
| 9 | 100 | — | 1.8 | 26 | 27 | — | 47 | — | 1400 | 45864 | −31.0 | 21 | 1.43 | |

TABLE 4

| Overall Evaluation | Specific Resistance μΩ cm | Resistance Change % | Consumption Current mA | SST M |
|---|---|---|---|---|
| ◎ The case when satisfying all the right conditions | 460 or more | 5 or less of absolute value | 173 or less | 1.5 or more |
| ○ The case of satisfying all the right conditions | 460 or more | Absolute value of 15 or less | 200 or less | 1.4 or more |
| The case when satifying at least one of the right conditions | less than 460 | Absolute value of greater than 15 | greater than 200 | less than 1.4 |

What is claimed is:

1. An ink jet head, comprising:

a discharge opening for discharging ink and an electrothermal transducer having a heat-generating resistor member which generates in accordance with a signal heat energy for discharging the ink through said discharge opening, wherein said heat-generating resistor member comprises a complex compound comprising each of a metal element, B, Si and N, said complex compound having the compositional ratios:

8 atomic %≦metal element≦31 atomic %

7 atomic %≦B≦58 atomic %

5 atomic %≦Si≦53 atomic %

6 atomic %≦N<45 atomic %.

2. The ink jet head according to claim 1, wherein said complex compound has the compositional ratios:

15 atomic %≦metal atom≦24 atomic %

18 atomic %≦B≦38 atomic %

19 atomic %≦Si≦35 atomic %

18 atomic %≦N≦38 atomic %.

3. The ink jet head according to claim 1, wherein the ratio of numbers of atoms of said Si and N contained in the complex compound is: 0.6≦Si/n<2.5.

4. The ink jet head according to claim 3, wherein the ratio of numbers of atoms of said Si and N contained in the complex compound is: 0.7<Si/N≦1.3.

5. The ink jet head according to claim 1, wherein said metal element contained in the complex compound is at least one element selected from the group consisting of Ti, V, Cr, Zr, Nb, Mo, Hf, Ta and W.

6. The ink jet head according to claim 1, wherein said metal element is a boride, and said Si is present both a silicon and as a nitride.

7. The ink jet head according to claim 1, wherein said heat-generating resistor member is a layer having a thickness of from 300 Å to 2 μm.

8. The ink jet head according to claim 7, wherein said heat-generating resistor member has a thickness of from 700 Åto 1 μm.

9. The ink jet head according to claim 8, wherein said heat-generating resistor member has a thickness of from 1000 Å to 5000 Å.

10. The ink jet head according to claim 1, wherein ink is discharged from said discharge opening substantially parallel to the direction in which the ink is fed to the portion of said heat generating resistor member where said heat energy is generated.

11. The ink jet head according to claim 1, wherein ink is discharged from said discharge opening in a substantially different direction than that in which the ink is fed to the portion of said heat-generating resistor member where said heat energy is generated.

12. The ink jet head according to claim 11, wherein said two directions are substantially perpendicular to each other.

13. The ink jet head according to claim 1, said ink jet head having plural ink discharge openings.

14. The ink jet head according to claim 13, wherein said plural discharge openings correspond to the width of the recording medium.

15. A substrate for an ink jet head, comprising: an electrothermal transducer having a heat-generating resistor member which generates in accordance with a signal heat energy utilized for discharging ink, wherein said heat-generating resistor member comprises a complex compound comprising each of a metal element, B, Si and N, said complex compound having the compositional ratios:

8 atomic %≦metal element≦31 atomic %

7 atomic %≦B≦58 atomic %

5 atomic %≦Si≦53 atomic %

6 atomic %≦N<45 atomic %.

16. The substrate for ink jet head according to claim 15, wherein said complex compound has the compositional ratios:

15 atomic %≦metal atom≦24 atomic %

18 atomic %≦B≦38 atomic %

19 atomic %≦Si≦35 atomic %

18 atomic %≦N≦38 atomic %.

17. The substrate according to claim 15, wherein the ratio of number of atoms of said Si and N contained in the complex compound is: b 0.6<Si/N≦2.5.

18. The substrate according to claim 17, wherein the ratio of numbers of atoms of said Si and N contained in the complex compound is: 0.7<Si/N≦1.3.

19. The substrate according to claim 15, wherein said metal element contained in the complex compound is at least one element selected from the group consisting of Ti, V, Cr, Zr, Nb, Mo, Hf, Ta and W.

20. The substrate according to claim 15, wherein said metal element is a boride, and said Si is present both as silicon and as a nitride.

21. The substrate according to claim 15, wherein said heat-generating resistor member is a layer having a thickness of from 300 U to 2 μm.

22. The substrate according to claim 21, wherein said heat-generating resistor member has a thickness of from 700 Å to 1 μm.

23. The substrate according to claim 22, wherein said heat-generating resistor member has a thickness of from 1000 Å t 5000 Å.

24. An ink jet apparatus, comprising:

an ink jet head comprising a discharge opening for discharging ink and an electrothermal transducer with a heat-generating resistor member for generating in accordance with a signal heat energy for discharging the ink from said discharge opening; and means for imparting to said electrothermal transducer the signal for discharging ink, wherein said heat-generating resistor member comprises a complex compound comprising each of a metal element, B, Si and N, said complex compound having the compositional ratios:

8 atomic %≦metal element≦31 atomic %

7 atomic %≦B≦58 atomic %

5 atomic %≦Si≦53 atomic %

6 atomic %≦N<45 atomic %.

25. The apparatus according to claim 24, further comprising a movable carriage on which said ink jet head is mounted.

26. The apparatus according to claim 24, further comprising conveying means for conveying a recording medium on which recording is to be effected with ink discharged from said discharge opening.

* * * * *

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 1:

Line 17, "Ink" should read --The ink--;

Line 20, "density and, s" should read --density, and is--;

Line 21, "formation," should read --formation--;

Line 24, "heat acting" should read --heat-acting--.

COLUMN 2:

Line 18, "or," should read --or--;

Line 44, "and," should read --and--.

COLUMN 3:

Line 20, "heat generating" should read --heat-generating--;

Line 25, "heat generating" should read --heat-generating--;

Line 34, "an" should read --for an--.

COLUMN 4:

Line 3, "later 1" should read --later,--;

Line 4, "imaged" should read --seen--.

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 5:

Line 6, "202" should read --212--;

Line 49, delete empty line.

COLUMN 6:

Line 13, "6 atomic % ≤ N < 45 atomic %." should read --6 atomic % ≤ N ≤ 45 atomic %.--;

Line 23, "tg" should read --to--.

COLUMN 7:

Line 46, "photo sensitivity" should read --photosensitivity--.

COLUMN 8:

Line 22, "inch" should read --inches--;

Line 27, "minutes" should read --minutes.--.

COLUMN 9:

Line 4, "the" should be deleted;

Line 22, "in" should be deleted;

Line 68, "and," should read --and--.

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 10:

Line 9, "heat generating" should read --heat-generating--;

Line 11, "head" should read --heads--;

Line 18, "of" should be deleted;

Line 44, "and," should read --and--;

Line 54, "Then,," should read --Then,--;

Line 64, "and," should read --and--.

COLUMN 11:

Line 17, "and" should read --or--;

Line 42, "and" should read --or--;

Line 67, "and" should read --or--.

COLUMN 12:

Line 23, "and" should read --or--;

Line 39, "was," should read --was--;

Line 40, "acqording" should read --according--;

Line 47, "and" should read --or--;

Line 53, "9ex-" should read --9, ex- --.

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 13:

Line 3, "and" should read --or--;

Line 27, "and" should read --or--;

Line 51, "and" should read --or--.

COLUMN 14:

Line 7, "and" should read --or--;

Line 18, "held" should read --head--;

Line 21, "apparatus" (first occurrence) should read --apparatus,--;

Line 58, "and above" should read --above and--.

COLUMN 15:

Line 28, "on demand" should read --on-demand--; and "and" should read --or--;

Line 33, "an" should be deleted;

Line 42, "taking" should read --making--;

Line 43, "shapes" should read --shapes,--;

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 16:

Line 3, "(linera" should read --(linear--;

Line 6, "4,558,333," should read --4,558,333 and--.

COLUMN 17 - TABLE 2:

| "Overall evaluation | should read | --Overall evaluation |
|---|---|---|
| ○ | | ○ |
| ○ | | ○ |
| | | △ |
| | | △ |
| | | △ |
| | | △ |
| | | △ |
| | | △ |
| " | | △ -- |

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

COLUMN 17 - TABLE 3:

| "Overall evaluation | should read | --Overall evaluation |
|---|---|---|
| ○ | | ○ |
| ⊙ | | ⊙ |
| ⊙ | | ⊙ |
| ⊙ | | ⊙ |
| | | △ |
| " | | △ -- |

COLUMN 17 - TABLE 4:

| "The case when satisfying at least one of the right conditions" | should read -- | △ The case when satisfying at least one of the right conditions--. |
|---|---|---|

COLUMN 18:

Line 34, "0.6 ≤ Si/n < 2.5." should read --0.6 < Si/N ≤ 2.5.--;

Line 43, "a" (second occurrence) should read --as--;

UNITED STATES PATENT AND TRADEMARK OFFICE

CERTIFICATE OF CORRECTION

PATENT NO. : 5,066,963

DATED : November 19, 1991

INVENTOR(S) : ISAO KIMURA, ET AL.

It is certified that error appears in the above-identified patent and that said Letters Patent is hereby corrected as shown below:

Line 50, "700 Åto" should read --700 Å to--;

Line 57, "heat generating" should read --heat-generating--.

COLUMN 19:

Line 18, "6 atomic % ≤ N < 45 atomic %." should read --6 atomic % ≤ N ≤ 45 atomic %.--;

Line 29, "b" should be deleted.

COLUMN 20:

Line 6, "300 U" should read --300 Å--;

Line 12, "t" should read --to--;

Line 29, "6 atomic % ≤ N < 45 atomic %." should read --6 atomic % ≤ N ≤ 45 atomic %.--.

Signed and Sealed this

Twenty-fifth Day of January, 1994

Attest:

Bruce Lehman

BRUCE LEHMAN

Attesting Officer

Commissioner of Patents and Trademarks